US006203616B1

(12) United States Patent
Murray, Jr. et al.

(10) Patent No.: US 6,203,616 B1
(45) Date of Patent: Mar. 20, 2001

(54) APPARATUS FOR APPLICATION OF A CHEMICAL PROCESS ON A COMPONENT SURFACE

(75) Inventors: Holt A. Murray, Jr., Hopewell, NJ (US); William Scott Loewenthal, Geauga, OH (US); Jacob Shverdin, Swampscott, MA (US)

(73) Assignee: Tyco Submarine Systems Ltd., Morristown, NJ (US)

( * ) Notice: Subject to any disclaimer, the term of this patent is extended or adjusted under 35 U.S.C. 154(b) by 0 days.

(21) Appl. No.: 09/285,049

(22) Filed: Apr. 2, 1999

(51) Int. Cl.[7] ..... B05C 13/02
(52) U.S. Cl. ..... 118/500; 118/503; 118/504
(58) Field of Search ..... 427/282; 118/500, 118/503, 504; 29/423, 424, 281.5, 235; 204/297 R, 224 R, 297 W, 272; 422/292; 269/47, 52

(56) References Cited

U.S. PATENT DOCUMENTS 3,440,705 * 4/1969 Johnson ..... 29/423
4,246,088 * 1/1981 Murphy et al. ..... 204/272
4,441,976 * 4/1984 Iemmi et al. ..... 204/224 R
4,690,747 * 9/1987 Smith et al. ..... 204/224 R
5,750,014 * 5/1998 Stadler et al. ..... 204/297 R

* cited by examiner

*Primary Examiner*—Laura Edwards

(57) ABSTRACT

In accordance with the present invention, an apparatus and method for application of a chemical process on a component surface is provided. In an embodiment for an apparatus for preparing a component surface for application of a chemical process, the apparatus includes a base, an o-ring retainer, an o-ring, a boot, and a retention ring. The component is mounted on the base. The o-ring is positioned on the o-ring retainer and the o-ring retainer is inserted through an aperture in the component and mated with the base. The assembled component, base, o-ring retainer, and o-ring are positioned within the boot. The retention ring is positioned around the boot. In an embodiment for a method for applying a wet chemical solution to the component surface to oxidize the component surface, where the wet chemical solution is contained within a tank, the method steps include immersing the component in the wet chemical solution, heating the wet chemical solution with a heater, and positioning the surface of the component in a horizontal, upward facing position and within the tank such that a baffle is disposed between the surface and the heater.

12 Claims, 16 Drawing Sheets

APPARATUS FOR APPLICATION OF A CHEMICAL PROCESS ON A COMPONENT SURFACE

BACKGROUND OF THE INVENTION

The present invention relates to an apparatus and method for application of a chemical process on a component surface. More specifically, the invention provides for applying a chemical process to a copper alloy plunger that is utilized in a fiber optic repeater to oxidize a portion of the surface of the plunger. The plunger is ultimately bonded with a polyethylene at the oxidation interface. The oxidized surface increases the bonding strength between the copper alloy plunger and the polyethylene.

Undersea fiber optic communication systems carry ever-increasing amounts of information. These systems are installed in-place under the oceans of the world and carry a large majority of the information that is transmitted between the world's continents. These fiber optic transmission systems remain in-place on the bottom of the ocean for years at a time.

Long distance undersea fiber optic transmission systems include fiber optic repeaters at regular intervals that regenerate the optical signals that are received at the repeaters so that the transmitted signal does not become so attenuated during its transmission that it cannot be interpreted at the receiving station. Because these repeaters are installed under the sea and rest on the sea bottom, these repeaters must withstand extreme pressures.

As can be seen in FIG. 1, typically the repeater 100 is formed as a cylindrical, metal container. An input fiber optic cable 10 delivers fiber optic signals into repeater 100 and an output fiber optic cable 120 carries the regenerated optical signals from repeater 100. Because the repeater is under extreme pressure when installed on the sea floor, a seal must be provided at the point of entry for cables 110, 120 into repeater 100. The seal is circular in cross-section and defines a central aperture that extends therethrough. Fiber optic cables 110 and 120 are inserted through the apertures in the seals and enter repeater 100.

FIG. 1 illustrates input seal 130 and output seal 140. Since each seal is similarly formed, only seal 130 will be discussed. Seal 130 is comprised of a copper alloy plunger 132 and a polyethylene portion 134. Copper alloy plunger 132 is bonded to polyethylene portion 134 through well-known methods. In order to increase the bonding strength between plunger 132 and polyethylene portion 134, a chemical process is applied to the surface 132A of plunger 132 that bonds with polyethylene portion 134. The chemical process oxidizes surface 132A of the copper alloy plunger.

However, there are problems with the currently known method of applying the chemical process. Currently, each copper alloy plunger individually receives the chemical process. The copper alloy plunger is masked, i.e., the surfaces that are not to receive the chemical treatment are covered such that only the surfaces that are to receive the chemical treatment are exposed, by a process that is time consuming. Additionally, once each plunger is masked, each plunger individually receives the chemical treatment. There is no known apparatus or method for simultaneously chemically treating multiple masked plungers. As a result, a great amount of time is required to chemically treat a plurality of plungers. It is only possible to mask and chemically treat approximately 6 plungers per day by utilizing currently known methods.

Additionally, problems exist with the presently known method for applying the chemical treatment. As stated above, the chemical treatment process oxidizes, and thus discolors, the treated surface of the copper plunger. Typically, in other commercial and private uses of oxidized components, the purpose of the oxidation process is solely to discolor the surface of the component for decorative purposes, e.g., ornamental household fixtures. Therefore, the microscopic properties, e.g., the chemical and structural composition, of the oxidized surface are not important; rather, only the aesthetic appearance of the oxidized surface is of interest.

Whereas presently known methods and apparatuses may be adequate for oxidizing surfaces where the success or failure of the treatment is determined by aesthetic criteria, these methods and apparatuses are not able to provide an oxidized surface that is sufficient to serve as a mating surface that can provide a strong bond to a polyethylene structure. Because the copper alloy plungers must bond with the polyethylene at the oxidized surface and because the bond between the two surfaces must withstand extreme pressures, it is imperative that a relatively uniform oxidized bonding surface be formed on the copper alloy plunger.

Therefore, it is desirable to provide an improved apparatus and method for application of a chemical process on a component surface.

SUMMARY OF THE INVENTION

In accordance with the present invention, an apparatus and method for application of a chemical process on a component surface is provided. In an embodiment for an apparatus for preparing a component surface for application of a chemical process, the apparatus includes a base, an o-ring retainer, an o-ring, a boot, and a retention ring. The component is mounted on the base. The o-ring is positioned on the o-ring retainer and the o-ring retainer is inserted through an aperture in the component and mated with the base. The assembled component, base, o-ring retainer, and o-ring are positioned within the boot. The retention ring is positioned around the boot. In an embodiment for a method for applying a wet chemical solution to the component surface to oxidize the component surface, where the wet chemical solution is contained within a tank, the method steps include immersing the component in the wet chemical solution, heating the wet chemical solution with a heater, and positioning the surface of the component in a horizontal, upward facing position and within the tank such that a baffle is disposed between the surface and the heater.

BRIEF DESCRIPTION OF THE DRAWINGS

The various features of the invention will best be appreciated by simultaneous reference to the description which follows and the accompanying drawings, in which.

DETAILED DESCRIPTION

Figure 1:
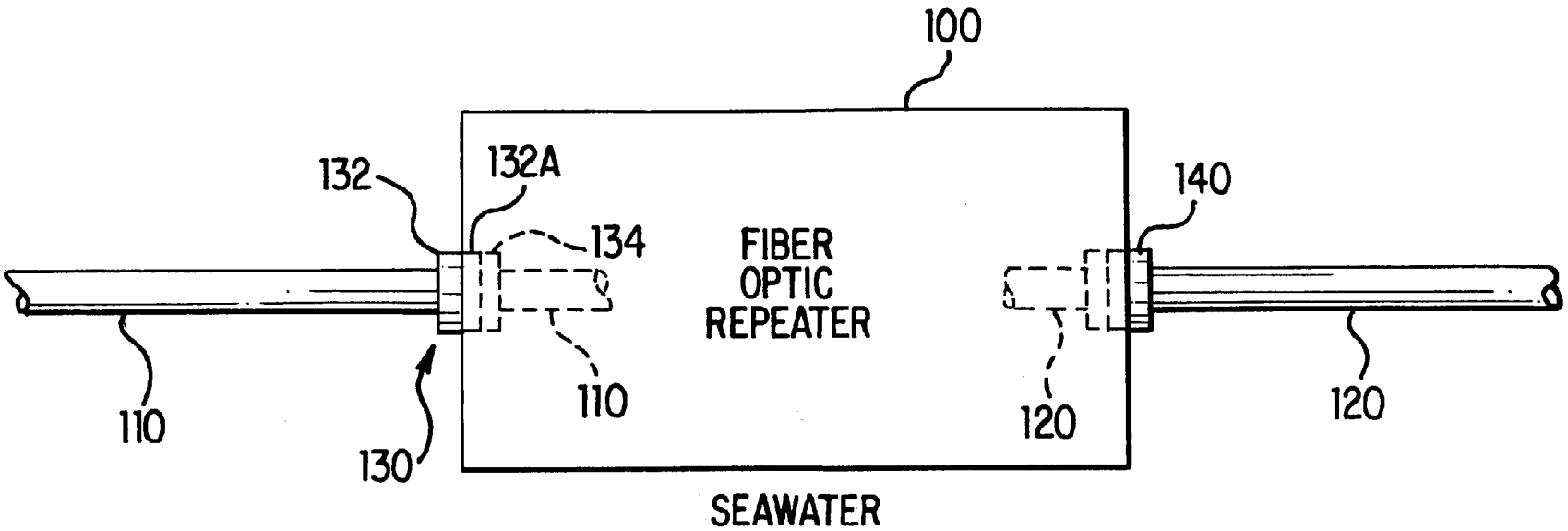
FIG. 1 illustrates a fiber optic repeater with an input fiber optic cable and an output fiber optic cable each entering the repeater through a seal.
Figure 2:
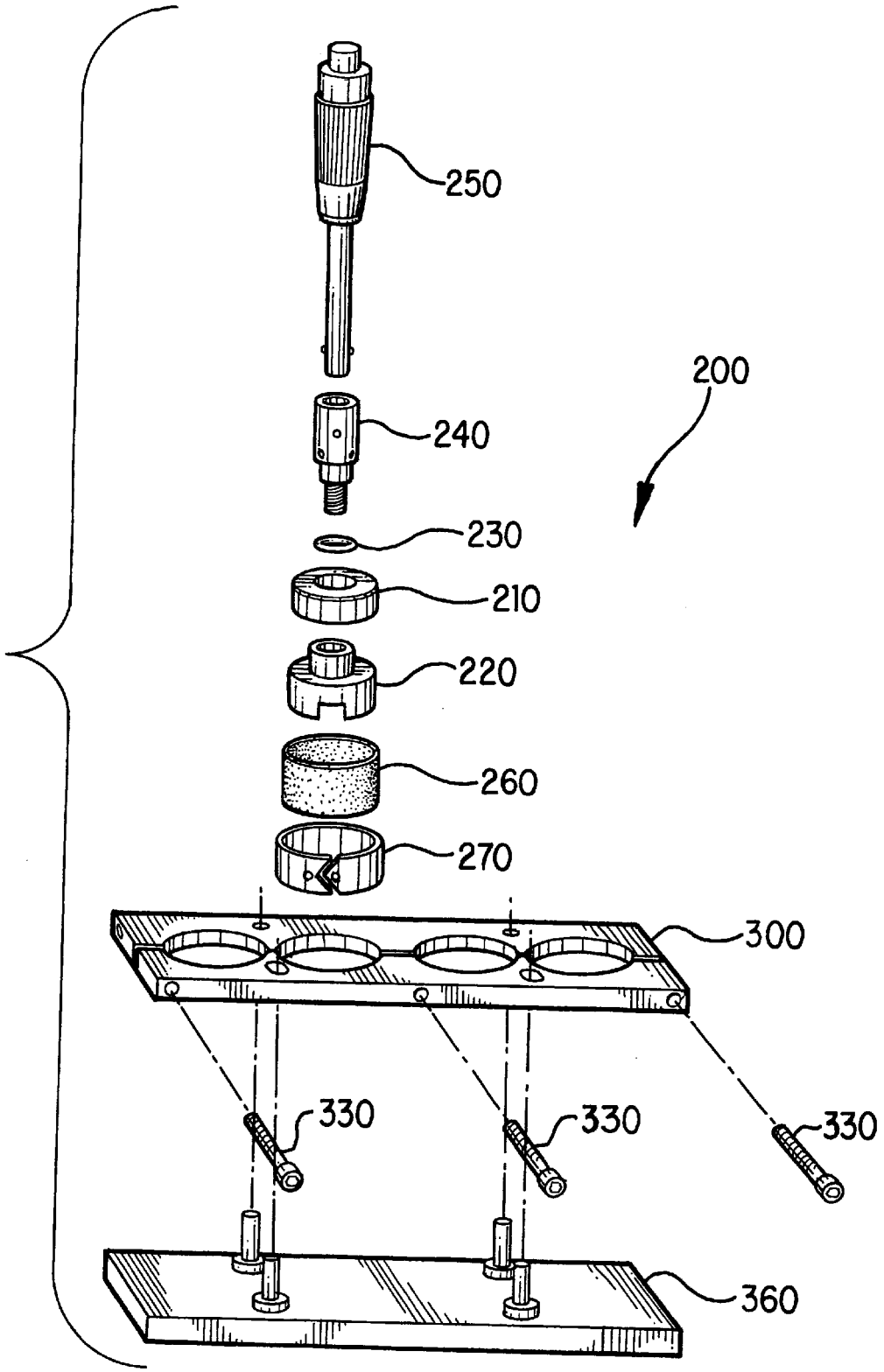
FIG. 2 is an exploded, perspective view of an embodiment for an apparatus for preparing a copper alloy plunger for application of a chemical process in accordance with the present invention.

FIG. 2 illustrates a first embodiment for an apparatus 200 for preparing a copper alloy plunger for application of a chemical process. Whereas the detailed description will describe the present invention in an embodiment for preparing a copper alloy plunger for application of a wet chemical process, the present invention is not limited to this embodiment. For example, the component that is prepared for receiving the chemical process could be comprised of ceramic, plastic, or organic materials, as well as other types of materials.

As can be seen in FIG. 2 and as will be described in more detail later in this specification, copper alloy plunger 210 is mounted onto plunger base 220. O-ring 230 is positioned onto o-ring retainer 240 where the assembled o-ring retainer 240 and o-ring 230 is then positioned through copper alloy plunger 210 and threadedly received within plunger base 220. Rubber boot 260 receives within it the copper alloy plunger 210 and plunger base 220 assembly. Retention ring 270 is positioned around rubber boot 260 after copper alloy plunger 210 and plunger base 220 have been positioned within rubber boot 260. Retainer tool 250 is operably couplable with o-ring retainer 240. When copper alloy plunger 210, plunger base 220, o-ring retainer 240, o-ring 230, and rubber boot 260 have been configured as described above, a masked copper alloy plunger has been assembled.

As will also be further explained later in this specification, the masked copper alloy plunger's upper beveled surfaces are exposed for application of the wet chemical process. Thus, the masking components mask all of the surfaces of the copper alloy plunger except those surfaces which are to receive the wet chemical process. Thus, the mask protects the surfaces of the copper alloy plunger that are not to receive the wet chemical process and leaves exposed the surfaces of the copper alloy plunger that are to receive the wet chemical process.

Also illustrated in FIG. 2 is an embodiment for a masked plunger holding fixture 300. The masked plunger holding fixture 300 defines a plurality of apertures therein which receive within them a masked plunger. After the masked plungers are secured within masked plunger holding fixture 300, the entire assembly is placed into an apparatus where the wet chemical process may be applied to copper alloy plungers 210. Thus, holding fixture 300 provides for application of the wet chemical process to a plurality of masked plungers in one procedure.

As will be further explained later in this specification, holding fixture 300 is comprised of a first half portion and a second half portion where each of the halves define one half of each of the plurality of masked plunger apertures. Securement members 330 join the two halves of holding fixture 300 together which in-turn securely fastens the masked plungers within holding fixture 300. Prior to positioning the masked plungers within holding fixture 300, holding fixture 300 is placed onto fixture platform tool 360. Positioning holding fixture 300 onto fixture platform tool 360 assists in the positioning of the masked plungers within holding fixture 300, as will also be further explained later.

Figure 3:
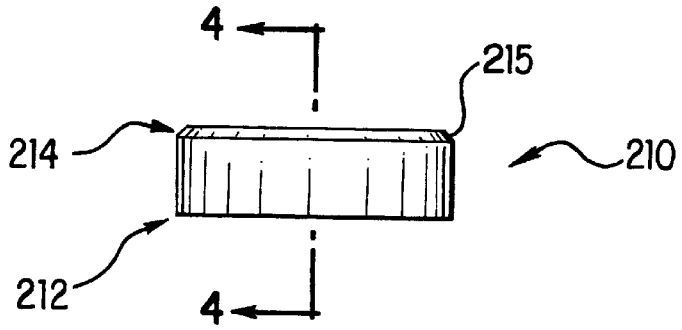
FIG. 3 is a side view of the copper alloy plunger.
Figure 4:
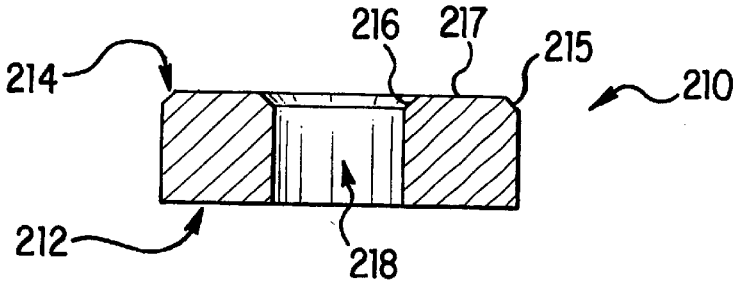
FIG. 4 is a cross-sectional view of the copper alloy plunger of FIG. 3 as taken along line 4—44 of FIG. 3.

FIGS. 3 and 4 illustrate copper alloy plunger 210. Plunger 210 is circular in cross-section and defines a central aperture 218 therethrough. Plunger 210 includes a seawater end 212 and an oxidation end 214. Seawater end 212 is that portion of plunger 210 that is exposed to the sea when plunger 210 has been installed within a repeater and which does not receive the wet chemical process. Oxidation end 214 is that portion of plunger 210 that serves as the interface with the polyethylene structure within the seal assembly and is thus that end of plunger 210 that is oxidized through the wet chemical process. The oxidation end 214, or top end, of plunger 210 includes an outside beveled surface 215, a top surface 217, and an inside beveled surface 216. Outside beveled surface 215 extends completely around an outer circumference of plunger 210 and inside beveled surface 216 extends completely around an inner circumference of plunger 210.

Figure 5:
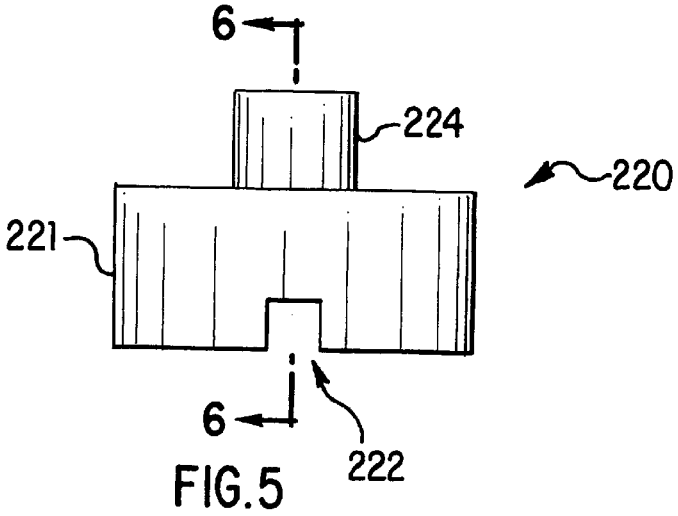
FIG. 5 is a side view of the plunger base.

FIG. 5 illustrates plunger base 220. Plunger base 220 includes a seat portion 221 and a mounting member 224. Both scat portion 221 and mounting member 224 are circular in cross-section. Seat portion 221 defines slot 222 which extends completely through seat portion 221. Plunger base 220 is comprised of a material that will not degrade from contact with the chemical treatment and may be manufactured from, e.g., 316 stainless steel.

Figure 6:
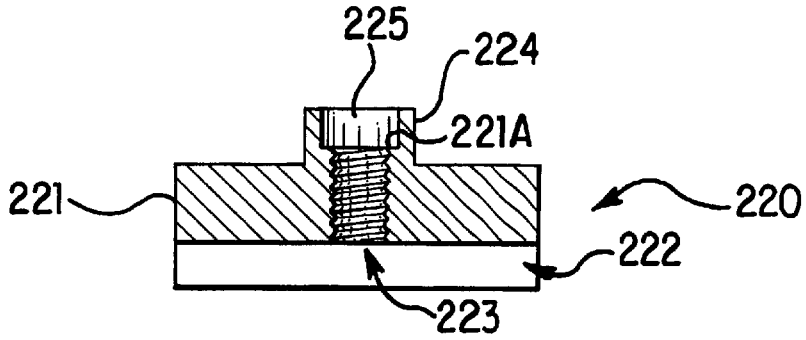
FIG. 6 is a cross-sectional view of the plunger base of FIG. 5 as taken along line 6—6 of FIG. 5.

FIG. 6 provides a cross-sectional view of plunger base 220. As can be seen in FIG. 6, mounting member 224 of plunger base 220 defines a central bore 225 which extends therethrough. Seat 221 further defines a threaded bore 223 which extends through the upper portion of seat 221, i.e., that portion of seat 221 that does not define slot 222. Within central bore 225 of mounting member 224, seat 221 defines a shoulder 221 A.

Figure 7:
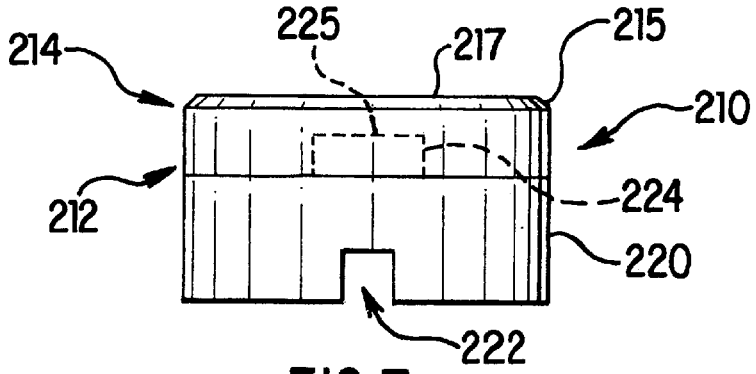
FIG. 7 is a side view of the plunger base and copper alloy plunger in an assembled configuration.

FIG. 7 illustrates an assembly where plunger 210 has been mounted onto plunger base 220. As can be seen, the outer diameter of copper alloy plunger 210 is the same as the outer diameter of plunger base 220. When copper alloy plunger 210 is mounted onto plunger base 220, mounting member 224 of plunger base 220 is received within central aperture 218 that is defined by copper alloy plunger 210. In FIG. 7 mounting member 224 is shown in phantom. The outside diameter of mounting member 224 is just sightly smaller than the diameter of central aperture 218 such that mounting member 224 is snugly received within central aperture 218.

When copper alloy plunger 210 has been mounted onto plunger base 220, the top end 225 of mounting member 224 is positioned below a lower end of the inside beveled surface 216 of copper alloy plunger 210. Thus, the entire inside beveled surface of copper alloy plunger 210 is not in contact with plunger base 220 and a portion of the structure of copper alloy plunger 210 which defines central aperture 218, and which is below the lower end of inside beveled surface 216, is also not in contact with plunger base 220 and are thus exposed surfaces with respect to plunger base 220.

As can also be seen in FIG. 7, the entire oxidation end 214 of copper alloy plunger 210 is not in contact with plunger base 220. Thus, outside beveled surface 215 is also an exposed surface when copper alloy plunger 210 is mounted onto plunger base 220.

Figure 8:
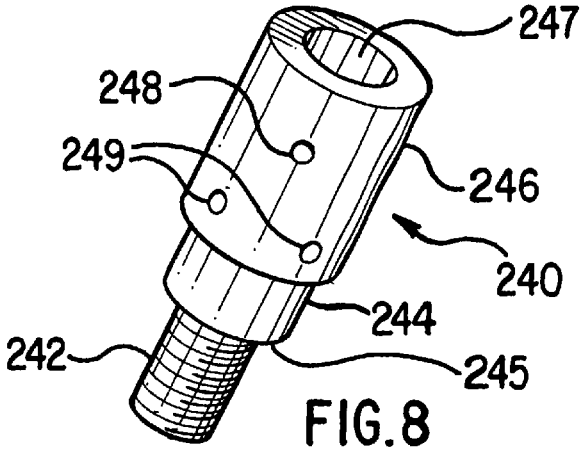
FIG. 8 is a perspective view of the o-ring retainer.

FIG. 8 illustrates an embodiment for o-ring retainer 240. As can be seen, o-ring retainer 240 includes a threaded stem portion 242, an o-ring mounting structure 244, and a tool receiving structure 246. Tool receiving structure 246 defines a central bore 247 that extends therethrough. Central bore 247 narrows at its lower end, i.e., that end closest to o-ring mounting structure 244. Tool receiving structure 246 also defines a retainer tool locking aperture 248, the purpose of which will be described later, and four drain holes 249, of which only two are visible in FIG. 8. The four drain holes 249 are equally spaced around the circumference of tool receiving structure 246 at the lower end of the tool receiving structure and extend completely through the wall of tool receiving structure 246 where they intersect with the narrow-diameter portion of bore 247. The purpose of the narrow portion of bore 247 is to funnel any liquid that enters bore 247 as a result of application of the wet chemical process to the lower portion of bore 247 such that it may be drained from bore 247, and thus o-ring retainer 240, through drain holes 249.

Figure 9:
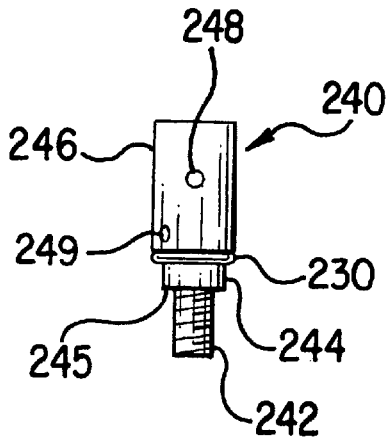
FIG. 9 is a side view of the o-ring retainer with an o-ring positioned thereon.

As was mentioned previously, o-ring retainer 240 receives an o-ring on it. The o-ring retainer 240 and o-ring are then mated with the assembled copper alloy plunger 210 and plunger base 220. FIG. 9 illustrates the positioning of o-ring 230 on o-ring retainer 240. As can be seen, o-ring 230 is positioned on an upper end of o-ring mounting structure 244. As can also be seen in FIG. 9, the outer diameter of o-ring 230 is generally the same diameter as that of tool receiving structure 246 of o-ring retainer 240. As will be further explained and illustrated later in FIGS. 13 and 14 o-ring mounting structure 244 and threaded stem 242 are received within central aperture 218 of copper alloy plunger 210. Threaded stem 242 is received within threaded bore 223 of plunger base 220. A portion of o-ring mounting structure 244 is received within central bore 225 of mounting member 224 of plunger base 220. Bottom surface 245 of o-ring mounting structure 244 engages with shoulder 221A of plunger base 220 to prevent further insertion of o-ring mounting structure 244 within mounting member 224.

When o-ring retainer 240 is positioned through central aperture 218 of copper alloy plunger 210 and into plunger base 220, o-ring 230 is positioned within central aperture 218 of copper alloy plunger 210 at a location such that the upper end of o-ring 230 is positioned just slightly below the lower end of inside beveled surface 216. As such, o-ring 230 is positioned 0.025 inches±0.010 inches below the lower end of inside beveled surface 216. Thus, as can be understood and as will be further discussed in connection with FIG. 14, when o-ring retainer 240 has been mated with plunger 210 and plunger base 220, the assembled structures of mounting structure 224 of plunger base 220 and o-ring 230 will leave the inside beveled surface 216 and a slight portion of the structure of copper alloy plunger 210 which defines central aperture 218, as described above, as the only inside surfaces of plunger 210 that are exposed.

Figure 10:
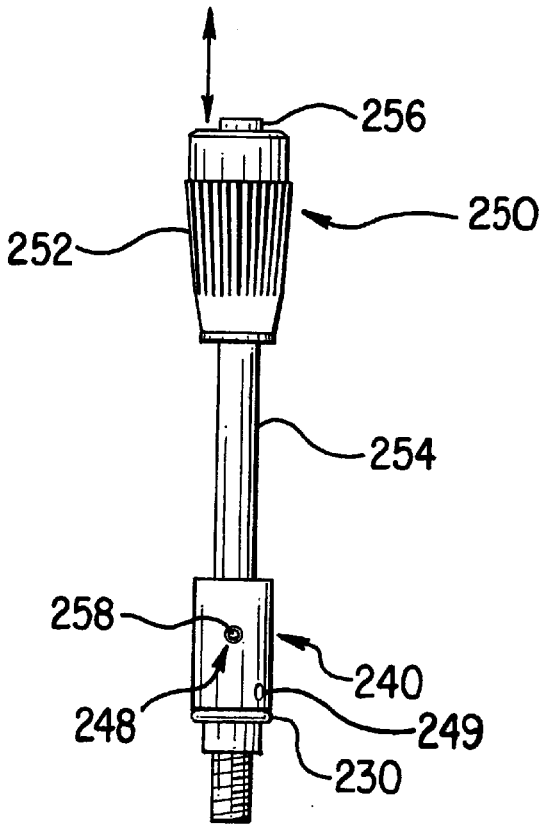
FIG. 10 is a side view of the assembled o-ring retainer and o-ring with the retainer tool coupled to the o-ring retainer.

FIG. 10 illustrates the assembled o-ring retainer 240 and o-ring 230 with the retainer tool 250 inserted therein. FIG. 10 illustrates one embodiment for retainer tool 250, however, the present invention is not limited to any particular embodiment for retainer tool 250. The purpose of retainer tool 250 is to engage with o-ring retainer 240 such that o-ring retainer 240 may be moved, positioned, and rotated such that it can be threadedly received within plunger base 220. Thus, retainer tool 250 provides for easy manipulation of o-ring retainer 240 by an operator.

In the embodiment of FIG. 10 for retainer tool 250, retainer tool 250 includes a handle portion 252, a stem 254, and an actuator 256. Actuator 256 is slidably movable within handle portion 252 and stem 254. Actuator 256 may be moved in the directions as illustrated by the arrows in FIG. 10. Actuator 256 cooperates with ball joint 258 that is carried in the lower end of stem 254, i.e., that portion of stem 254 that is inserted within o-ring retainer 240. Ball joint 258 is carried within stem 254 and is biased outward from stem 254 through apertures that are included in the lower end of stem 254. When actuator 256, which is biased into its upper most position with respect to handle portion 252, is inserted further into handle portion 252, the portion of actuator 256 that cooperates with ball joint 258 allows the biasing force that biases ball joint 258 outward from the aperture in stem 254 to be relaxed. Thus, the ball joint can be retracted within stem 254. With the actuator 256 and the ball joint 258 retracted within stem 254, retainer tool 250, and thus stem 254, may be rotated within o-ring retainer 240. When ball joint 258 aligns with retainer tool locking aperture 248 and the pressure on actuator 256 is released, ball joint 258 is again biased outward from stem 254 where it is received within aperture 248 of o-ring retainer 240. Thus, through the interaction of ball joint 258 with aperture 248 of o-ring retainer 240, retainer tool 250 is coupled to o-ring retainer 240.

As can be understood, if an operator desires to release retainer tool 250 from o-ring retainer 240, the operator would depress actuator 256 which would in-turn remove the outward biasing force applied to ball joint 258. Ball joint 258 may then be retracted from aperture 248, thus allowing retainer tool 250 to be removed from o-ring retainer 240. Again, the embodiment of FIG. 10 for retainer tool 250 is only one of a variety of different embodiments that may be utilized for providing a tool for manipulating o-ring retainer 240 and the present invention is not limited to any particular embodiment for retainer tool 250.

Figure 11:
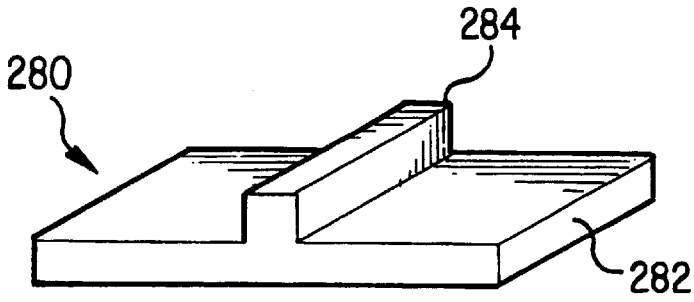
FIG. 11 is a perspective view of an embodiment for a tightening plate.

As was mentioned previously, o-ring retainer 240 is positioned through copper alloy plunger 210 and threaded into plunger base 220. In order to restrain plunger base 220 from rotating when threading o-ring retainer 240 into plunger base 220, a tightening plate 280 may be utilized in the present invention. FIG. 11 illustrates an embodiment for tightening plate 280. As can be seen in FIG. 11, tightening plate 280 includes a base 282 from which extends tongue 284. Tongue 284 is an elongated member that extends from base 282 and along the entire width of base 282, in this embodiment.

Figure 12:
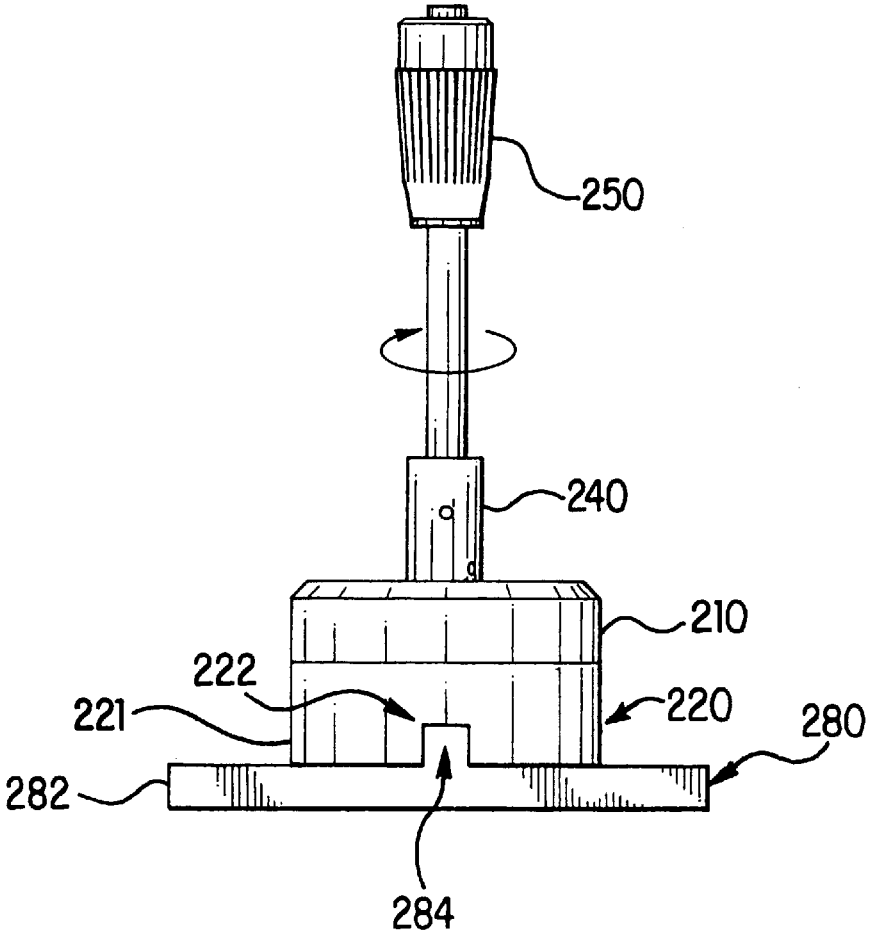
FIG. 12 is a side view of the plunger base, plunger, o-ring retainer, and retainer tool as positioned on the tightening plate.

As can be understood, and as illustrated in FIG. 12, plunger base 220 is positioned onto tightening plate 280 prior to threading o-ring retainer 240 through copper alloy plunger 210 and into plunger base 220. Slot 222, which is defined by seat 221 of plunger base 220, receives within it tongue 284 of tightening plate 280. Thus, as o-ring retainer 240 is threaded into plunger base 220, the interaction of plunger base 220 with tightening plate 280 will prevent plunger base 220 from rotating.

Figure 13:
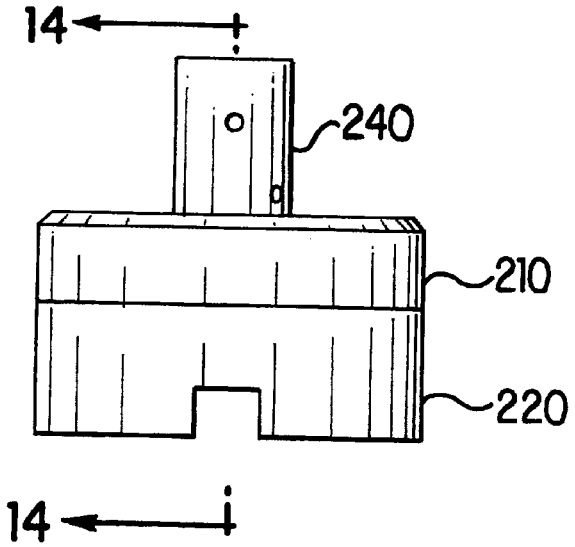
FIG. 13 is a side view of the plunger base, plunger, and o-ring retainer in an assembled configuration.
Figure 14:
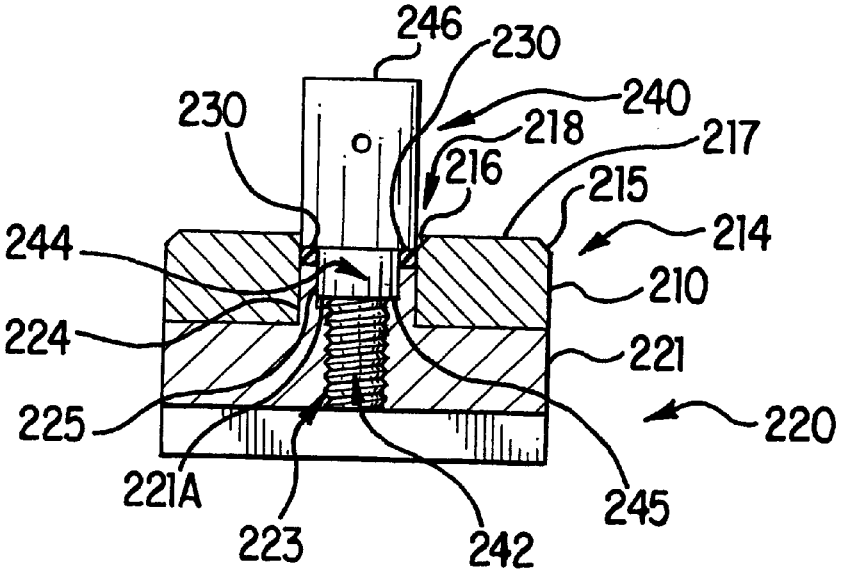
FIG. 14 is a cross-sectional view of the assembly of FIG. 13 as taken along line 14—14 of FIG. 13.

FIGS. 13 and 14 illustrate an assembled configuration for o-ring retainer 240, copper alloy plunger 210, and plunger base 220. As was discussed previously, o-ring retainer 240 is received within central aperture 218 of plunger 210 and is threaded into bore 223 which is defined by seat 221 of plunger base 220. A lower portion of o-ring mounting structure 244 is received within central bore 225 of mounting member 224 of plunger base 220. Bottom surface 245 of o-ring mounting structure 244 engages with shoulder 221A of seat 221 to prevent further insertion of o-ring retainer 240 into plunger base 220.

As can also be seen in FIG. 14, o-ring 230 is positioned between the upper surface of mounting member 224 and the lower surface of the structure which defines tool receiving structure 246 of o-ring retainer 240 and within central aperture 218 of plunger 210. As mentioned previously, the upper end of seal 230 is positioned approximately 0.025 inches±0.010 inches below the lower end of inside beveled surface 216 of copper alloy plunger 210. Thus, the only interior surfaces that are exposed on plunger 210 is the inside beveled surface 216 and that slight portion of the surface defining central aperture 218 that is located below the lower end of inside beveled surface 216. Thus, o-ring 230 establishes a liquid seal and an inside masking boundary for copper alloy plunger 210. The liquid seal established by o-ring 230 prevents any liquid as applied during the wet chemical treatment process from contacting the interior surfaces of plunger 210 except those that are deliberately exposed, as described above.

As can be further seen in FIG. 14, and as discussed previously, the entire outside beveled surface 215 and the entire top surface 217 of plunger 210 are not in contact with any surfaces and are thus exposed surfaces.

Figure 15:
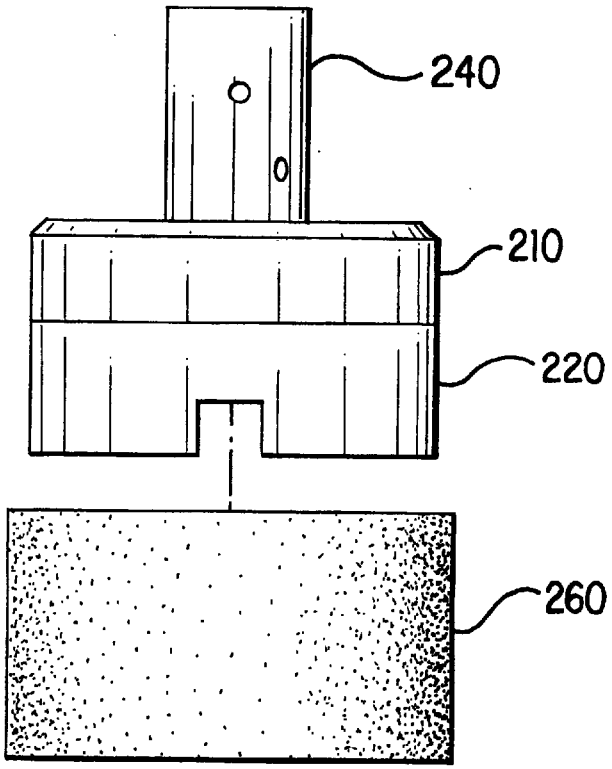
FIG. 15 is a side view of the plunger base, plunger, and o-ring retainer assembly as it is about to be inserted into the rubber boot.
Figure 16:
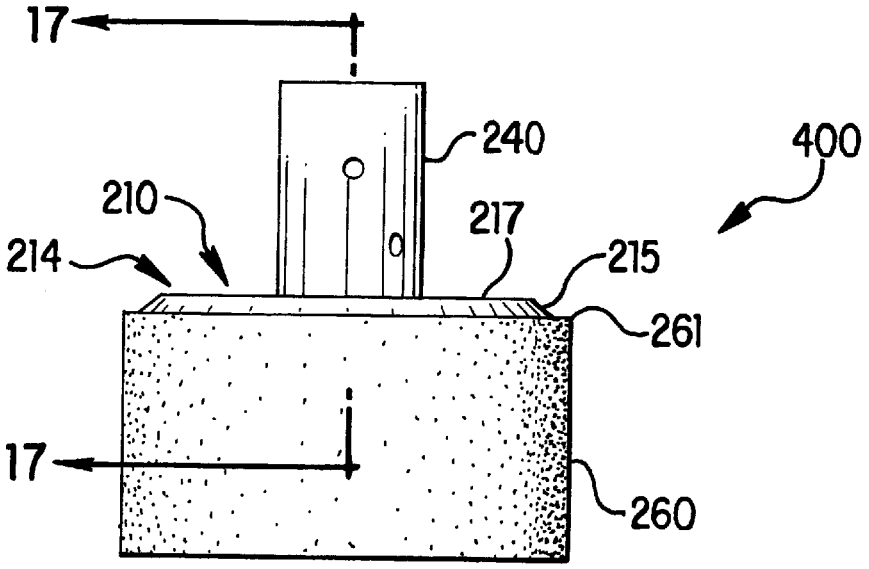
FIG. 16 is a side view of a masked plunger.
Figure 17:
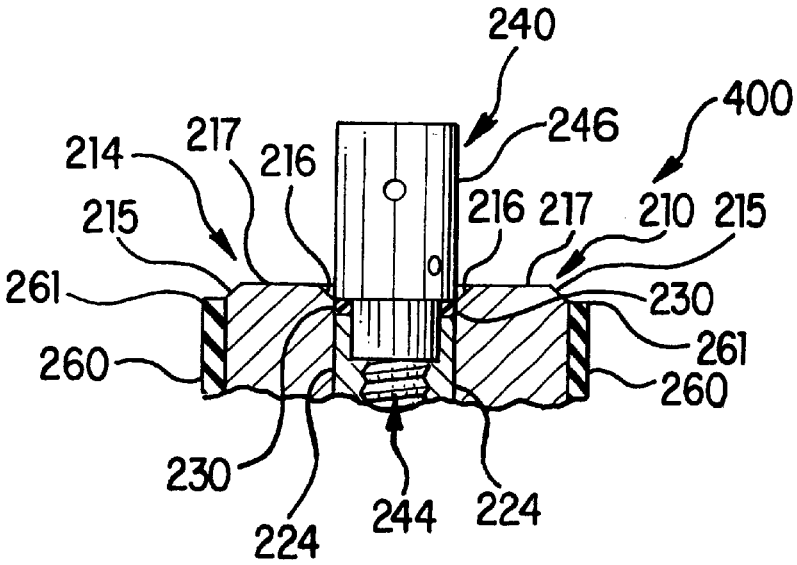
FIG. 17 is a cross-sectional view of the masked plunger of FIG. 16 as taken along line 17—17 of FIG. 16.

FIGS. 15 through 17 illustrate the o-ring retainer 240, copper alloy plunger 210, and plunger base 220 assembly as it is received within rubber boot 260. Rubber boot 260 is a hollow structure that includes a circumferential rubber wall and a rubber base. The assembled o-ring retainer 240, copper alloy plunger 210, and plunger base 220 is positioned within boot 260. As can be seen in FIGS. 16 and 17, when the assembly is positioned within boot 260, oxidation end 214 of plunger 210 extends above a top edge 261 of boot 260, and is therefore exposed from boot 260. As such, outside beveled surface 215, top surface 217, and inside beveled surface 216, along with the additional structure on the interior of copper alloy plunger 210 as described earlier, are exposed from boot 260. As such, boot 260 masks the outer surface of copper alloy plunger 210 such that the surface covered by boot 260 will not be subject to the wet chemical process. As with the positioning of o-ring 230 with respect to inside beveled surface 216, top 261 of rubber boot 260 is positioned a distance of approximately 0.025 inches±0.010 inches below the lower end of outside beveled surface 215.

For reference purposes for the remainder of this specification, the assembly of the o-ring retainer 240, o-ring 230, copper alloy plunger 210, plunger base 220, and rubber boot 260 will be referred to as a masked plunger 400. As was described previously, and as can be understood, masked plunger 400 provides for only exposing those surfaces of copper alloy plunger 210 which are to receive the wet chemical treatment process thereon.

Figure 18:
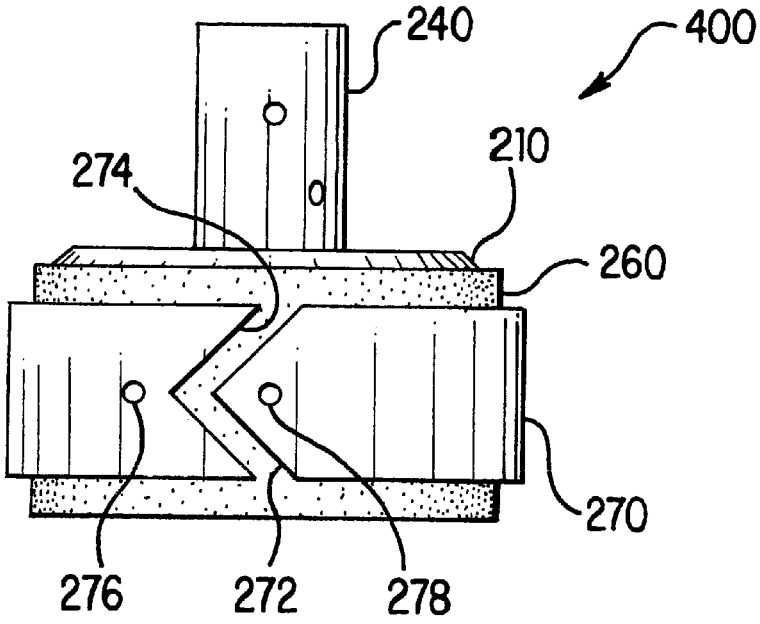
FIG. 18 is a side view of the masked plunger and the retainer ring.

FIG. 18 illustrates retainer ring 270. Retainer ring 270 can be manufactured from stainless steel and is a circular ring that is positioned around rubber boot 260. Retainer ring 270 is discontinuous in its circumference and includes complementary surfaces at ends 272 and 274. The complementary surfaces are formed in a v-shaped configuration such that as the retainer ring 270 is compressed around rubber boot 260, the complementary surfaces may align. Retainer ring 270 is provided to support masked plunger 400 and provide additional strength to masked plunger 400 as it is received within masked plunger holding fixture 300, as will be further explained later. The purpose for the discontinuity in the circumference of retainer ring 270 is to provide for being able to position retainer ring 270 around boot 260 but yet being able to compress retainer ring 270 when the masked plunger is securely received within holding fixture 300. As can also be seen in FIG. 18, apertures 276 and 278 are defined by retainer ring 270. The purpose of apertures 276 and 278 are to receive prongs from a tool that may be used to grip retainer ring 270 and place retainer ring 270 over boot 260.

The wall structure that comprises retainer ring 270 may be formed with a uniform interior surface, i.e., that surface that contacts rubber boot 260, such that the entire surface area of the interior surface contacts rubber boot 260. Alternatively, the interior surface may be formed in a u-shaped configuration such that only the upper-most most and lower-most surface areas of the interior surface contact the rubber boot 260. Forming the interior surface of retainer ring 270 in this configuration may provide for increased pressure at the contacting surfaces when the retainer ring 270 is compressed around rubber boot 260.

As was described previously, and as is illustrated in FIG. 19, a plurality of masked plungers 400 may be positioned within holding fixture 300. Holding fixture 300 defines a plurality of masked plunger apertures 340, each of which may receive a masked plunger 400 within it. As such, a plurality of masked plungers 400 may be fixtured within holding fixture 300 such that the plurality of masked plungers 400 may be positioned at the same time within a machine for treatment by the wet chemical process.

Figure 19:
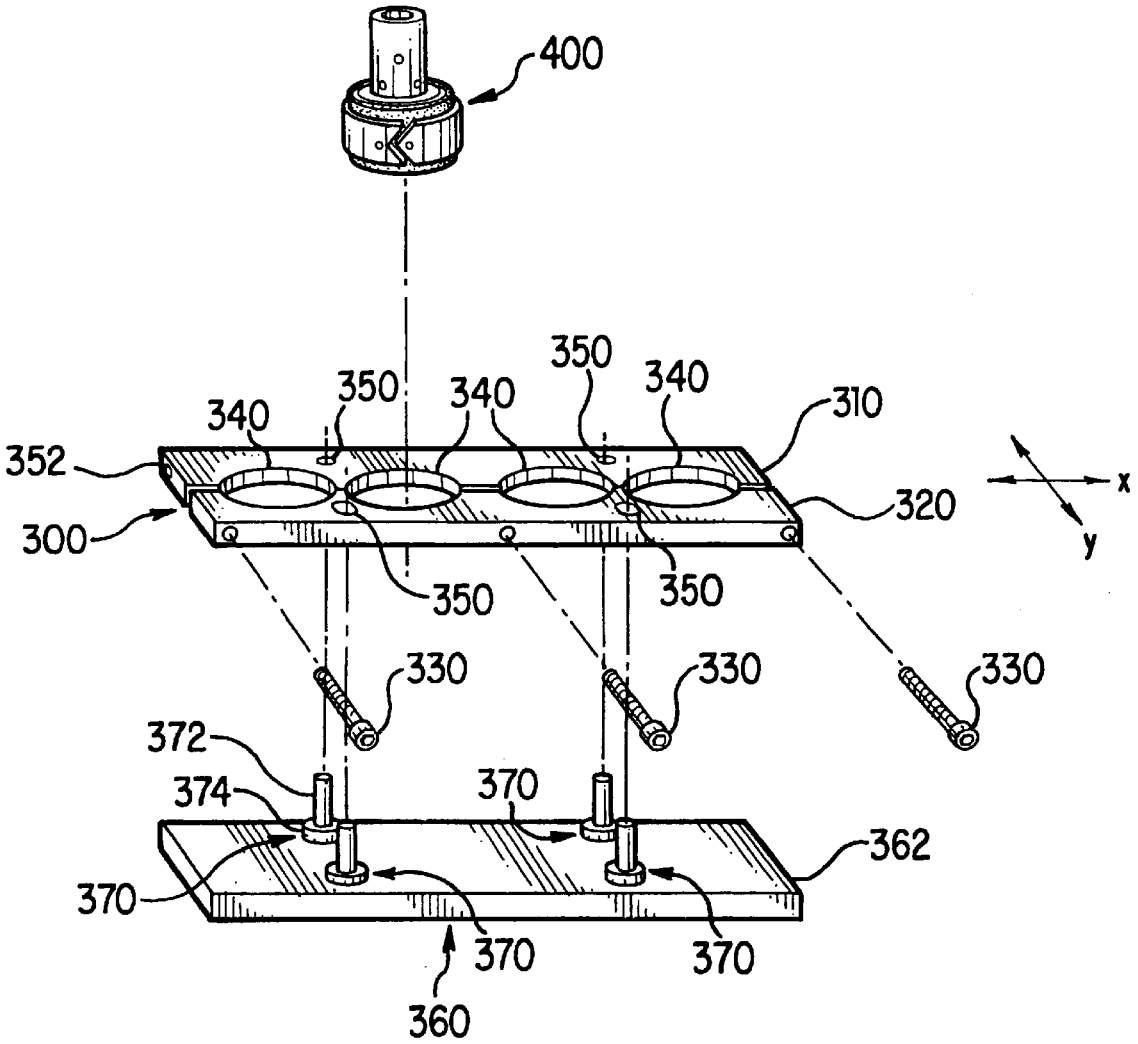
FIG. 19 is an exploded perspective view of the masked plunger, holding fixture, and fixture platform.

Holding fixture 300 will now be described in further detail. As can be seen in FIG. 19, holding fixture 300 is comprised of a first half portion 310 and a second half portion 320. Thus, holding fixture 300 may be divided in half along its longitudinal axis. As such, first half portion 310 defines one half of each of the plurality of masked plunger apertures 340 and second half portion 320 defines the other half portion of each of the plurality of masked plunger apertures 340. Securement members 330 are received within one of the half portions of holding fixture 300 and extend through to the other of the half portions of holding fixture 300 and thus join first half portion 310 to second half portion 320. As such, securement members 330 may be threadedly received within first half portion 310 and/or second half portion 320.

It is desirable that each of the plurality of masked plunger apertures, and thus the masked plungers, be positioned a distance $P_1$ of between one-quarter to an entire diameter width PW of a masked copper alloy plunger apart from each other. Additionally, the circumferential edge closest to a longitudinal end of fixture 300 of an encased masked plunger closest to the end of fixture 300 should be positioned a distance $P_2$ from the longitudinal end of the holding fixture that is at least equivalent to the height H of the copper alloy plunger that extends above the upper surface of the holding fixture. These positions can be clearly seen in FIG. 22.

Before the masked plungers 400 are inserted into the masked plunger apertures 340, holding fixture 300 is mounted onto fixture platform tool 360. Fixture platform tool 360 includes a base 362 upon which are included four mounting pins 370, in this embodiment. Each mounting pin 370 is formed by a head portion 372 and a shoulder portion 374. Head portion 372 of each pin 370 is received within one of four pin apertures 350 that are included in holding fixture 300. When head 372 has been received within pin aperture 350, holding fixture 300 rests upon shoulder 374 such that fixture 300 is positioned a distance above base 362 of fixture platform tool 360. Shoulder 374 extends a height above base 362 such that when holding fixture 300 is positioned on fixture platform tool 360, a separation distance is maintained between holding fixture 300 and fixture platform tool 360 such that as the masked plungers 400 are inserted within the masked plunger apertures 340, the masked plungers will be properly positioned within the masked plunger apertures such that the compressive forces exerted by holding fixture 300 on masked plungers 400 will be received by retainer rings 270. Thus, when masked plungers 400 are inserted within masked plunger apertures 340, the bottoms of boots 260 rest upon base 362 and retainer rings 270 are positioned within the structure of holding fixture 300 that defines masked plunger apertures 340. In this manner, as described above, the forces applied by holding fixture 300 on masked plungers 400 are received by retainer rings 270, which are structurally strong members, particularly when compared to the strength of the rubber boots 260.

After the masked plungers 400 are positioned within holding fixture 300, securement members 330 are threaded into holding fixture 300 in order to draw first half portion 310 and second half portion 320 together. The drawing of first half portion 310 to second half portion 320 will tighten holding fixture 300 around each of the masked plungers 400 and will thus rigidly retain masked plungers 400 within holding fixture 300.

Pin apertures 350 in holding fixture 300 may be formed in different configurations. For example, the two pin apertures 350 on first half portion 310 could be formed as circularly-shaped apertures and the two pin apertures 350 on second half portion 320 could be formed as oblong slots with a longitudinal axis perpendicular to the longitudinal axis of holding fixture 300. Forming the pin apertures in such a manner would permit for aligning holding fixture 300 on fixture platform tool 360 on both the X longitudinal axis and the Y transverse axis. The first half portion 310 and second half portion 320 of holding fixture 300 are aligned on the X axis by positioning pins 370 within apertures 350. When securement members 330 are threaded into holding fixture 300 to draw second half portion 320 towards first half portion 310, the oblong slots 350 in second half portion 320 allow second half portion 320 to move along the Y axis relative to pins 370. Thus, the positioning and relative movement of pins 370 within oblong slots 350 serve to align and guide second half portion 320, and thus holding fixture 300, on the transverse Y axis as the second half portion 320 is drawn toward the first half portion 310 on fixture platform tool 360.

After each of the masked plungers 400 are inserted and retained within holding fixture 300, the position of the boots 260 on the plungers 210 should be inspected such that the top edge 261 of each boot 260 is positioned with respect to outside beveled surface 215 as described previously. If the positioning of boot 260 with respect to copper alloy plunger 210 has shifted as a result of securing masked plunger 400 within holding fixture 300, the masked plunger 400 should be removed from holding fixture 300 and the boot should be repositioned on copper alloy plunger 210.

Figure 20:
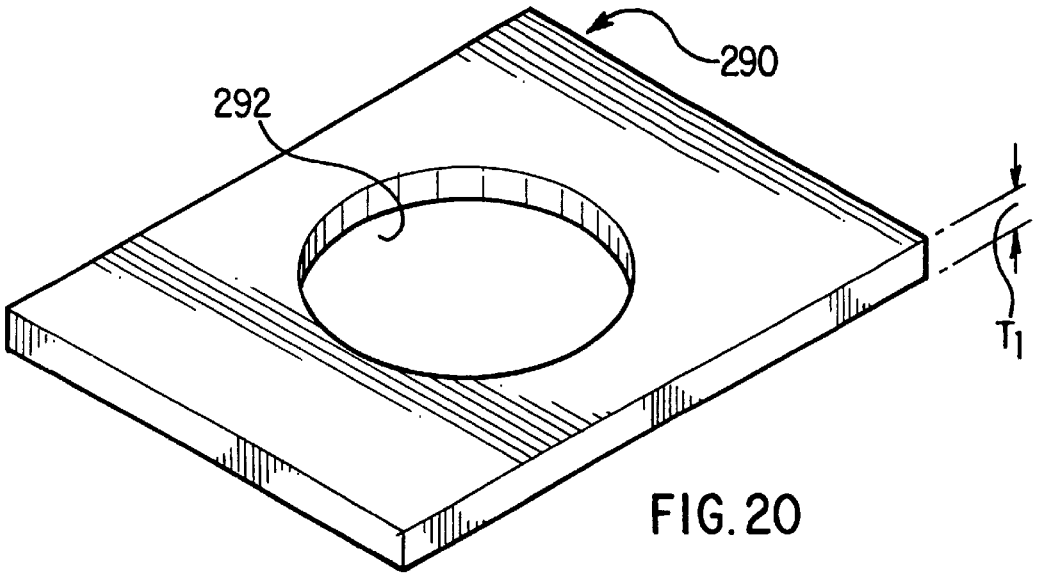
FIG. 20 is a perspective view of an embodiment of a positioning plate in accordance with the present invention.
Figure 21:
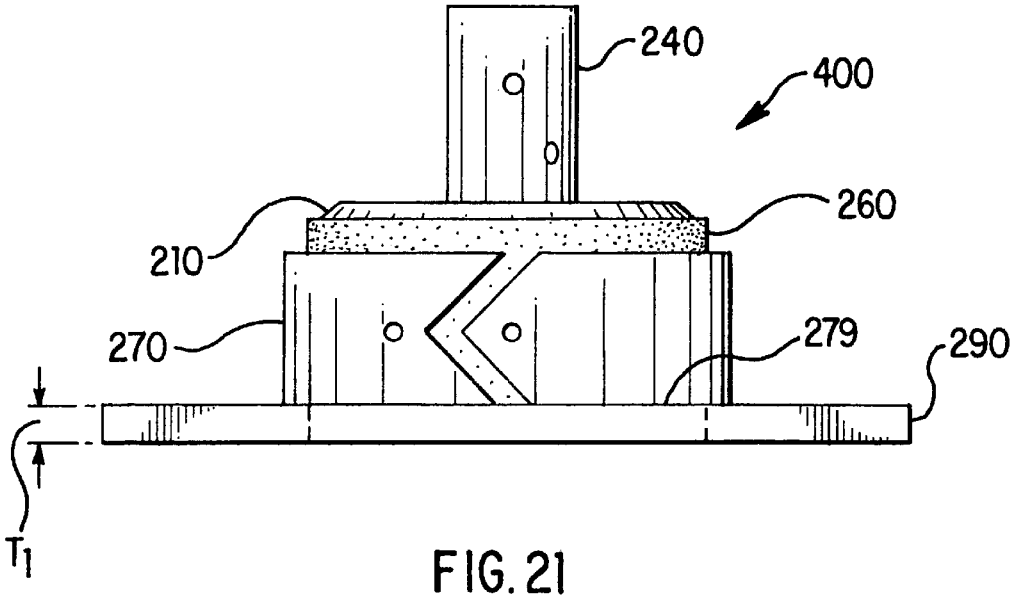
FIG. 21 is a side view of a masked plunger inserted within the positioning plate with the retainer ring positioned on the masked plunger.

It was mentioned previously that stainless steel retainer ring 270 is positioned around, and on, rubber boot 260. In order to assist in positioning retainer ring 270 on rubber boot 260, a positioning plate 290, as illustrated in FIG. 20, may be utilized. As can be seen in FIG. 20, positioning plate 290 has a uniform thickness $T_1$ of 0.250±0.010 inches and defines an aperture 292 within it. Aperture 292 has a diameter that is able to accommodate rubber boot 260 of masked plunger 400 within it. In order to position retainer ring 270 on rubber boot 260, the bottom of rubber boot 260, and thus masked plunger 400, is positioned within aperture 292 of positioning plate 290, as illustrated in FIG. 21. Retainer ring 270, which is of a larger diameter than aperture 292 and is thus not able to be positioned within it, is positioned around rubber boot 260 such that it engages on its lower-most edge 279 with positioning plate 290. In this manner, the lower-most edge 279 of retainer ring 270 is accurately positioned 0.250±0.010 inches above the bottom surface of rubber boot 260.

Figure 22:
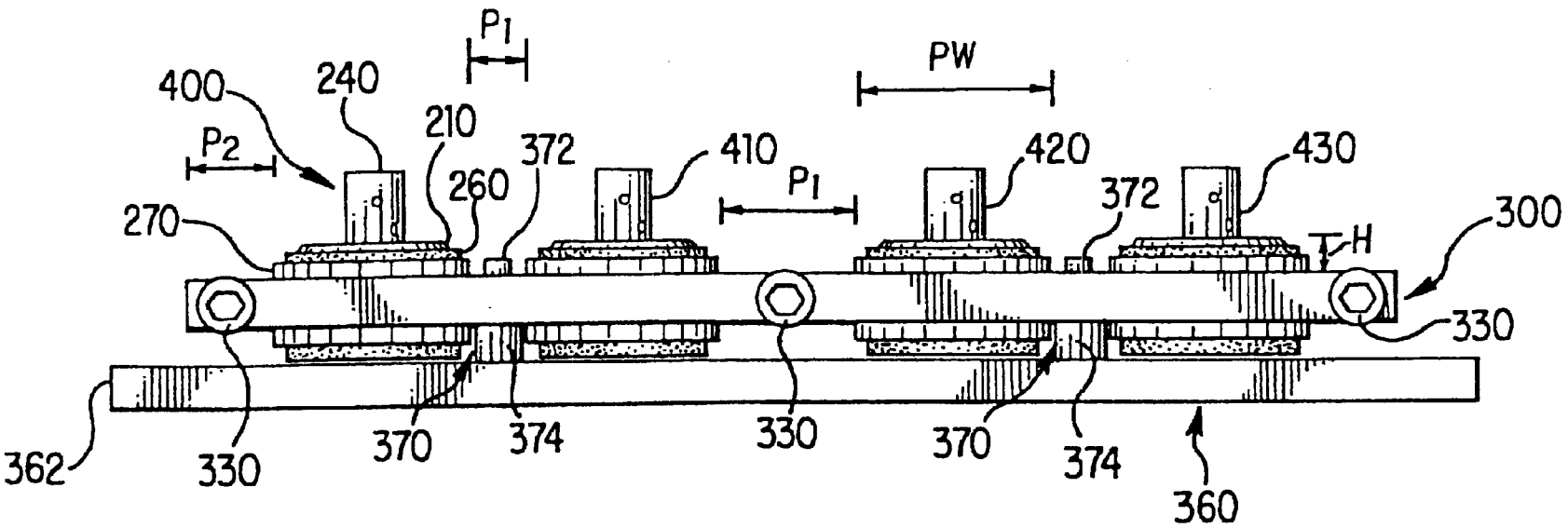
FIG. 22 is a side view of a plurality of masked plunger as fixtured within the holding fixture.

As can be seen in FIG. 22, in this embodiment, up to four masked plungers may be fixtured within holding fixture 300. As such, masked plungers 400, 410, 420, and 430, are retained within holding fixture 300. As can also be seen in FIG. 22, holding fixture 300 is resting upon shoulder portions 374 of pins 370. As such, heads 372 of pins 370 are received within the pin apertures that are defined by holding fixture 300. After each of the masked plungers 400, 410, 420, and 430 have been inserted within holding fixture 300, securement members 330 are threaded into holding fixture 300 to securely mate first half portion 310 and second half portion 320 of holding fixture 300 around each of the masked plungers.

Figure 23:
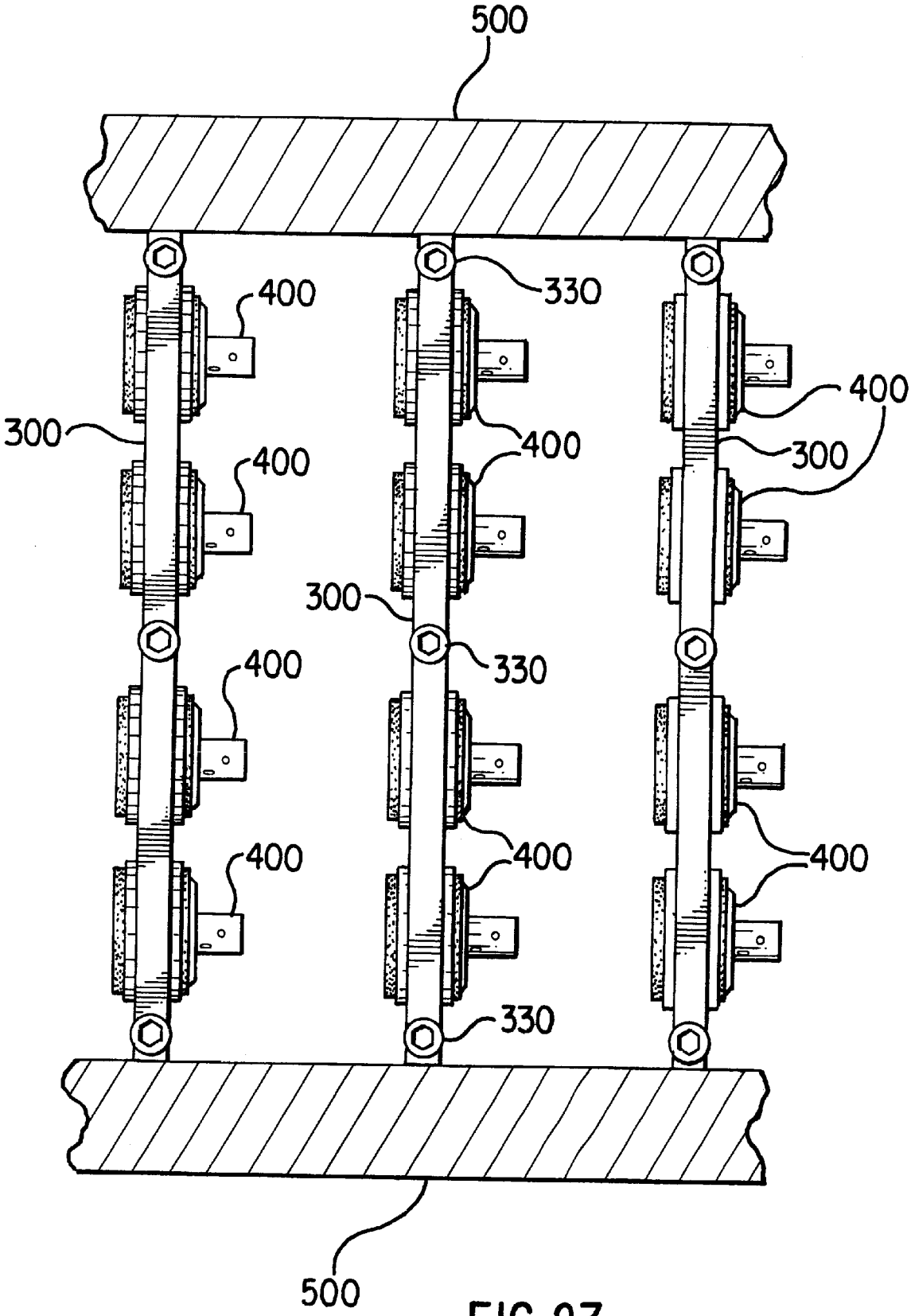
FIG. 23 is a partial cut-away view of a chemical treatment process wire rack with a plurality of holding fixtures, each containing a plurality of masked plungers, secured within the wire rack for application of the chemical process.

After each of the masked plungers have been retained within holding fixture 300, holding fixture 300 is removed from fixture platform tool 360 and fixture 300 is secured within a chemical treatment process wire rack 500, as illustrated in FIG. 23. Once holding fixture 300 has been secured within chemical treatment process wire rack 500, the chemical treatment process may be applied to each of the masked plungers simultaneously. The chemical treatment process wire rack 500 may contain pins that are received within wire rack apertures 352 that are included at each end of holding fixture 300, one of which is visible in FIG. 19. However, the present invention is not limited to any particular embodiment for a chemical treatment process wire rack. In the illustrated embodiment, three fixtures 300, each containing from one to four masked plungers, are placed onto chemical treatment process wire rack 500. Thus, potentially up to twelve masked plungers may simultaneously undergo the wet chemical treatment process when practicing the present invention. Whereas FIG. 23 illustrates the holding fixtures being oriented vertically within the process wire rack, it may be advantageous to orient the holding fixtures horizontally such that the exposed surfaces of the masked plungers are facing upward, as will be discussed later in this specification.

Figure 24:
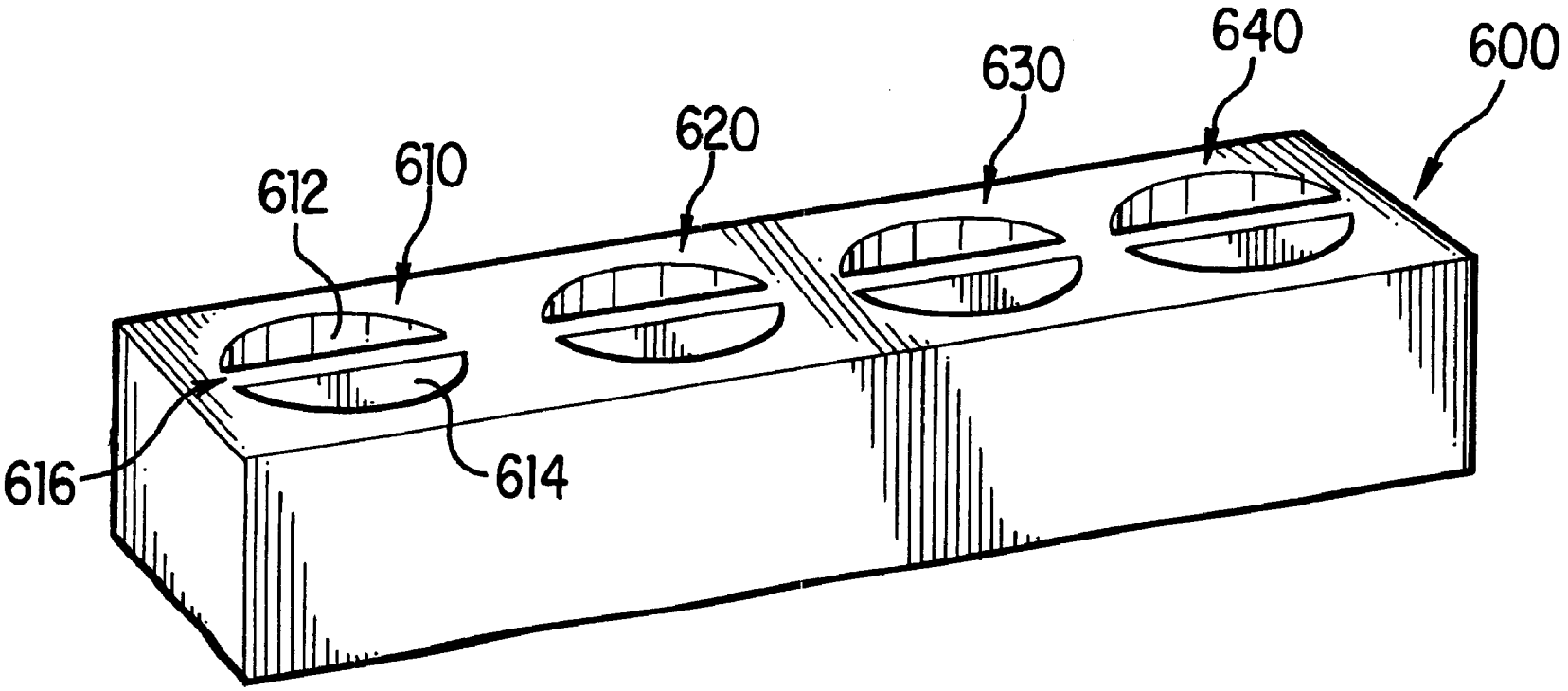
FIG. 24 is a perspective view of an alternative embodiment for the tightening plate.

FIG. 24 illustrates an alternative embodiment for a tightening plate as discussed previously. As will be remembered, the tightening plate provides for restraining plunger base 220 against rotation as o-ring retainer 240 is threaded into plunger base 220. The embodiment of FIG. 11 for tightening plate 280 includes a single tongue 284 on a base 282. In the embodiment of FIG. 24, tightening plate 600 includes four tightening stations such that four plunger bases 220 may be accommodated on a single tightening plate. Tightening stations 610, 620, 630, and 640 may be seen in FIG. 24. Since each tightening station is similarly formed, a discussion will only be provided for tightening station 610. Tightening station 610 is defined by a first recess 612 and a second recess 614. Recess 612 and recess 614 define between them a tongue 616. Tongue 616 is received within slot 222 of a plunger base 220. Structure of seat 221 of plunger base 220 which defines slot 222 is received within recesses 612 and 614. Thus, when slot 222 of plunger base 220 receives tongue 616 within it, as o-ring retainer 240 is threaded into plunger base 220, plunger base 220 is restrained against rotation by tightening station 610.

The present invention also provides an improved method and apparatus for applying the wet chemical treatment process. In the present invention, after the copper alloy plungers have been cleaned and prepared for receipt of the chemical process, the plungers are masked and fixtured as described above. The plungers may be cleaned and prepared by any of a variety of methods and the present invention is not limited to any process for these steps. After masking and fixturing, the plungers are immersed in an etching solution and rinsed. The prepared plungers are then placed into the oxidizing solution. Again, the post-masking and fixturing etching and rinsing process can utilize any of a variety of methods and the present invention is not limited to any particular process for these steps.

Figure 25:
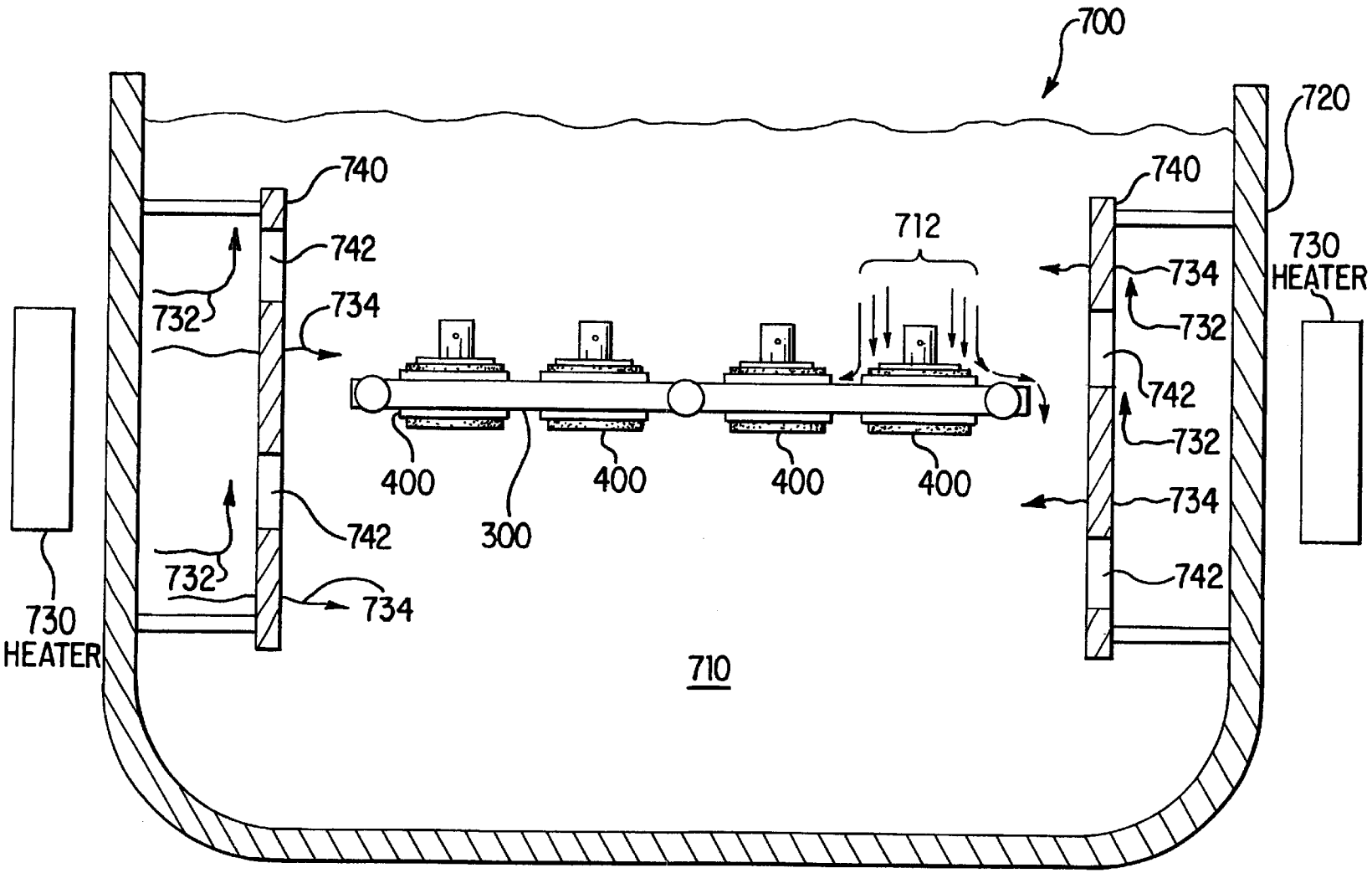
FIG. 25 is a cross-sectional view of an embodiment for an oxidation tank assembly.

FIG. 25 illustrates an embodiment for an oxidation tank assembly 700 that may be utilized when practicing the present invention. As can be seen, a wet chemical oxidation solution 710 is contained within tank 720. The oxidation solution could be any of a variety of chemicals depending upon the material composition of the component that is to receive the treatment process and the characteristics required for the oxidation surface and the present invention is not limited to any particular physical configuration for tank 720 or chemical composition for oxidation solution 710.

Disposed within tank assembly 700 is a fixture 300 which contains a plurality of masked plungers 400. Fixture 300 may be secured to the walls of tank 720 through support brackets that are not visible in FIG. 25. As can be seen in FIG. 25, and as discussed earlier, the fixture 300 is positioned within tank 720 such that the surface of each of the masked plungers that are to be oxidized are placed horizontal and facing upwards. This is desirable because, with the oxidation surfaces facing upwards, in a direction opposed to a flow direction for the wet chemical due to the forces of gravity acting upon the wet chemical, a more evenly distributed flow pattern of the wet chemical across the entire surface area of the oxidation surface can be achieved as represented by flow pattern 712 of wet chemical 710. An evenly applied and distributed flow pattern of the wet chemical across the surface area of the oxidation surface will result in a more uniform formation of the oxidation surface on the copper alloy plunger. As can be understood, if the oxidation surface was oriented vertically within tank 720, the wet chemical would flow down the surface of the oxidation surface and result in an uneven formation of the oxidation surface on the copper alloy plunger which would result in a weaker bond when the surface is bonded with the polyethylene. Additionally, the horizontal orientation of the oxidation surfaces in combination with the positioning of the masked plungers 400 within fixture 300, as discussed and illustrated in FIG. 22, provides for a more evenly distributed flow pattern of the wet chemical across the oxidation surface of the copper alloy plunger. For example, if the outer-most edge of an oxidation surface was positioned directly adjacent to the longitudinal end of fixture 300, again, there could be the possibility of near vertical flow of the wet chemical across that outer-most edge of the oxidation surface. By positioning the masked plungers a distance from the longitudinal ends of fixture 300 and from each other, a more controlled flow pattern can be achieved across the oxidation surface, and thus a more uniform oxidation surface can be chemically grown on the copper alloy plunger, which will result in a stronger bond between the copper alloy plunger and the polyethylene.

As can also be seen in FIG. 25, heaters 730 are provided near the walls of tank 720. The heaters arc utilized to heat the wet chemical solution which enhances the formation of the oxidation surface on the copper alloy plungers. The heaters may be any of a variety of different types of heating devices and the present invention is not limited to any particular embodiment for a heater. In fact, whereas the heaters are illustrated as being located outside of tank 720, the heaters could be either integrally formed within the wall of tank 720 or positioned within tank 720. However, the heaters should not be positioned underneath the plungers during the oxidizing process. The heaters heat the solution to a temperature of between 208±5° F.

Baffles 740 may also be provided in tank 720. Baffles 740 may be formed of separate structural members or may be a single structural member and may extend around an entire inner circumference of tank 720 or around a portion thereof. Baffles 740 are positioned within tank 720 between fixture 300 and heaters 730. The purpose of baffles 740 are to reduce the movement, and thus agitation, of the wet chemical solution 710 that may be caused by the heating of the solution by heaters 730. It is desirable that minimal agitation of the wet chemical solution occurs so that a more uniform oxidation surface can be grown on the copper alloy plungers. Because the solution is heated, convection currents 732 are likely to develop in the solution which may travel from the heat source and be propagated in a direction toward the fixture 300. Baffles 740 serve to redirect the convection currents such that they do not directly flow across the forming oxidation surface and also serve to attenuate the currents. However, baffles still allow heat 734 to pass through baffles 740 through conduction of the heat from heaters 730.

Baffles 740 may be formed of any of a variety of materials and may include apertures 742 within them. Any sizing and positioning of apertures 742 would be based on further optimizing the function of baffles 740, as described above.

As discussed above, when the plungers are immersed within the wet chemical solution, the solution should not be boiled or stirred while the treatment is being applied to the plungers. Additionally, the processing temperature range, discussed above, should be reestablished, if necessary, within two minutes after immersing the plungers into the solution. Gentle agitation should only be accomplished within the first two minutes of immersion.

Figure 26:
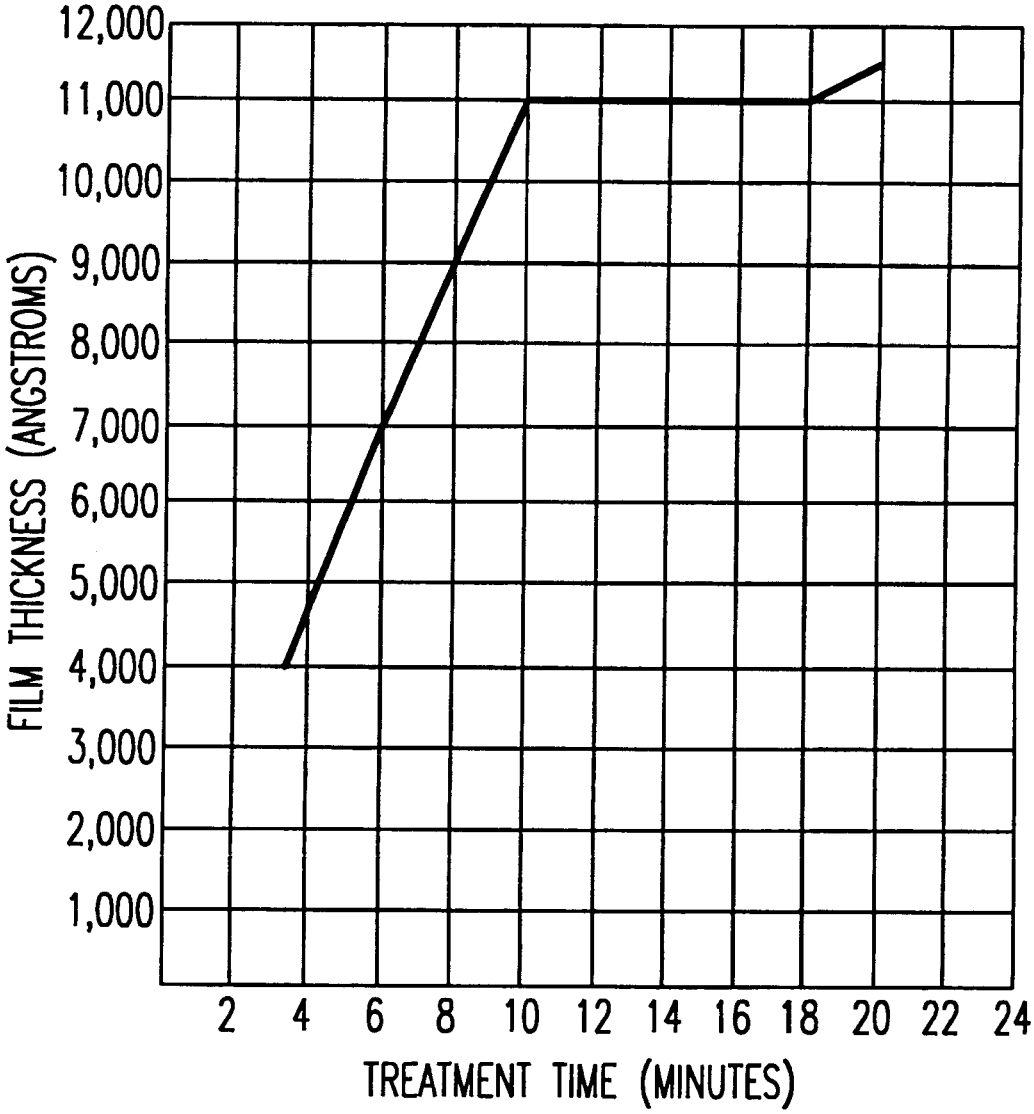
FIG. 26 is a graph of oxidation surface thickness versus time of treatment.

The plungers should remain in the wet chemical solution for approximately 18–22 minutes, with a target time being 20 minutes. An oxidizing time of at least 10 minutes is required. It has been found that because the oxidation surface is chemically grown on the copper alloy plunger, the thickness of the oxidation surface is a function of the duration of time that the copper alloy plungers are immersed in the wet chemical. As can be seen in FIG. 26, the thickness of the oxidation surface grows significantly during the first 10 minutes of immersion, virtually stops growing during the next 8 minutes, and continues to grow much less rapidly thereafter. Whereas an immersion time of less than 5 minutes is adequate for oxidation surfaces that are formed for aesthetic and decorative purposes, a longer immersion time is required to grow a thicker and denser oxide layer.

After the masked plungers are removed from the wet chemical solution, the plungers are rinsed in a rinse tank, running deionized water over them for ten minutes at room temperature. The fixtured plungers are then removed from the tank, visually inspected, and moved to a final rinse station. The fixtured plungers are then rinsed for two minutes at room temperature. The specific resistance of the rinse water is monitored and 2 megohms minimum shall be reached within 30 seconds after immersing fixtured plungers.

To dry the plungers, the plungers may be spin-dried and/or blow dried. However, in addition to any other drying step, the plungers are then oven dried. The fixtured plungers are placed in a drying oven for 60 minutes at a temperature of between 100–400° F., and preferably between 120–130° F.

After drying, the masked plungers are unmasked and removed from the fixture by reversing the process steps as described previously. The plungers are the placed onto a metal or glass tray by utilizing a lifting tool to lift the plungers. The plungers are then baked under nitrogen ($N_2$) and air. The tray of plungers is placed into a drying oven and dried for 120 minutes at a temperature of at least 200° F. The tray of plungers is then removed and placed into a dry box under a nitrogen atmosphere.

With respect to all of the variety of additional or different method steps that may be practiced with the present invention, regardless of the steps utilized, it may be desirable to store the plungers in deionized water between each of the process steps.

In this manner, therefore, as discussed in above in this detailed description, an improved apparatus and method for application of a chemical process on a component surface is described. As discussed earlier, the present invention is not limited to being practiced with any particular component for application of the chemical process. Additionally, embodiments of the present invention are not limited to only be practiced with a wet chemical process. The disclosed embodiments are illustrative of the various ways in which the present invention may be practiced. Other embodiments can be implemented by those skilled in the art without departing from the spirit and scope of the present invention.

What is claimed is:

1. An apparatus for preparing a component surface for application of a chemical process, the component defining an aperture therein and including an upper inside beveled surface extending around an inner circumference and an upper outside beveled surface extending around an outer circumference, comprising:

a base, the component mounted on said base;

an o-ring retainer;

an o-ring, said o-ring positioned on said o-ring retainer;

said o-ring retainer extending through the aperture defined by the component and threadedly received within said base;

a boot, said base and the component received within said boot; and a retention ring, said retention ring positioned around said boot.

2. The apparatus of claim 1 further comprising a holding fixture, said holding fixture defining a plurality of holding fixture apertures therein for receiving said base with the component mounted thereon, said o-ring retainer, said o-ring, said boot, and said retention ring.

3. The apparatus of claim 2 wherein said holding fixture includes:

a first half portion comprising a first half of each of said plurality of holding fixture apertures;

a second half portion comprising a second half of each of said plurality of holding fixture apertures; and a securement member, said securement member joining said first half portion to said second half portion.

4. The apparatus of claim 2 further comprising a fixture platform tool, said fixture platform tool including a plurality of pins wherein each of said pins includes a head portion and a shoulder portion and wherein said holding fixture is positioned on said fixture platform tool, said head portion of each of said pins received within one of a plurality of pin apertures defined by said holding fixture and said holding fixture supported on said shoulder portions.

5. The apparatus of claim 1 wherein a top end of said boot is positioned approximately 0.025 inches below the upper outside beveled surface extending around the outer circumference of the component.

6. The apparatus of claim 1 wherein said o-ring is positioned approximately 0.025 inches below the upper inside beveled surface extending around the inner circumference of the component.

7. The apparatus of claim 1 wherein said base defines a slot extending therethrough and further comprising a tightening plate, said tightening plate including a tongue, said tongue received within said base slot.

8. The apparatus of claim 1 further comprising a retainer tool, said retainer tool operably couplable to said o-ring retainer.

9. The apparatus of claim 1 wherein said retention ring is discontinuous in circumference and includes complementary surfaces at a first end thereof and a second end thereof.

10. An apparatus for application of a chemical process to a plurality of masked components, each of said plurality of masked components having unmasked surfaces including an outside beveled surface, a top surface, and an inside beveled surface, said apparatus comprising:

a holding fixture comprising a plurality of holding fixture apertures, each of said plurality of masked components received within one of said plurality of holding fixture apertures, said holding fixture including a first half portion comprising a first half of each of said plurality of holding fixture apertures, a second half portion comprising a second half of each of said plurality of holding fixture apertures, and a securement member for joining said first half portion to said second half portion; and a fixture platform tool including a plurality of pins wherein each of said pins includes a head portion and a shoulder portion and wherein said holding fixture is positioned on said fixture platform tool, said head portion of each of said pins being received within one of a plurality of pin apertures defined by said holding fixture and said holding fixture being supported on said shoulders portions.

11. The apparatus of claim 10 wherein each of said plurality of masked components includes a rubber boot wherein a top end of said boot is positioned approximately 0.025 inches below the outside beveled surface.

12. The apparatus of claim 10 wherein each of said plurality of masked components includes an o-ring wherein said o-ring is positioned approximately 0.025 inches below the inside beveled surface.

* * * * *